US005839025A

United States Patent [19]

Okauchi et al.

[11] Patent Number: 5,839,025

[45] Date of Patent: Nov. 17, 1998

[54] IMAGE FORMING APPARATUS HAVING A WINDOW FOR ILLUMINATING PAPER DISCHARGED TO A DISCHARGE SECTION

[75] Inventors: Yoshifumi Okauchi; Tetsuro Tomoe; Yukihiro Itoh; Masahiko Miyazaki; Syouji Hirano, all of Osaka, Japan

[73] Assignee: Mita Industrial Co., Ltd., Osaka, Japan

[21] Appl. No.: 861,784

[22] Filed: May 22, 1997

[30] Foreign Application Priority Data

May 31, 1996 [JP] Japan ..... 8-138390

[51] Int. Cl.[6] ..... G03G 21/20

[52] U.S. Cl. ..... 399/92; 399/405

[58] Field of Search ..... 399/92, 124, 405, 399/107; 271/207

[56] References Cited

U.S. PATENT DOCUMENTS

| | | | |
|---|---|---|---|
| 3,966,194 | 6/1976 | Abbe et al. | 271/186 |
| 4,903,076 | 2/1990 | Sakakibara | 399/124 |
| 5,191,383 | 3/1993 | Watanabe | 399/124 |
| 5,532,826 | 7/1996 | Miyao et al. | 358/296 |

FOREIGN PATENT DOCUMENTS

| | | |
|---|---|---|
| 2-198968 | 8/1990 | Japan . |
| 6-148998 | 5/1994 | Japan . |
| 6-286243 | 10/1994 | Japan . |
| 7-267466 | 10/1995 | Japan . |

*Primary Examiner*—Robert Beatty
*Attorney, Agent, or Firm*—Beveridge, DeGrandi, Weilacher & Young, LLP

[57] ABSTRACT

An image forming apparatus has a paper discharging section provided in its main body. The paper discharging section opens toward the front of the main body. An opening serving as a window for introducing light into the paper discharging section is provided on a side surface of the main body. Light enters the paper discharging section through the opening, so that the paper discharging section is brightened. As a result, it is possible to easily visually confirm whether or not a paper sheet exists in the paper discharging section. Additionally, vent holes adjacent the window opening serve to introduce cooling air along the axis of a fusing roller.

7 Claims, 7 Drawing Sheets

IMAGE FORMING APPARATUS HAVING A WINDOW FOR ILLUMINATING PAPER DISCHARGED TO A DISCHARGE SECTION

CROSS REFERENCE TO RELATED APPLICATION

This application claims priority benefits under 35 USC § 119 of Japanese Patent Application Serial No. 8-138390 filed on May 31, 1996, the disclosure of which is incorporated by reference.

BACKGROUND OF THE INVENTION

1. Field of the Invention

The present invention relates to an image forming apparatus capable of performing a multi-function such as a copy function and a facsimile function.

2. Description of Related Art

In recent years, the demand for an image forming apparatus performing a multi-function has increased. There is provided an image forming apparatus on which a copy function, a FAX function, a printer function, a PC-FAX function, a scanner function, and the like are carried, for example. Such a multi-function image forming apparatus can be used even in a narrow office because significant economy of space is achieved, as compared with a case where a plurality of apparatuses corresponding to the respective functions are arranged.

On the other hand, when a paper feeding cassette for feeding paper sheets for image recording and a paper discharge tray for discharging the paper sheets each having an image recorded thereon are projected from both sides of the main body of the image forming apparatus, a wider setting space is required. Therefore, there is provided an image forming apparatus so adapted that a paper feeding cassette can be loaded in its main body and having a paper discharge space provided in the main body.

Generally, a space in front of the main body of the image forming apparatus is a vacant space for operating the image forming apparatus, so that the paper feeding cassette can be taken out forward. Further, the paper discharge space opens toward the front of the main body of the image forming apparatus, so that the paper sheets discharged into the paper discharge space are taken out forward.

However, the paper discharge space is set in the main body of the image forming apparatus, whereby the inside thereof is liable to be darkened. Therefore, it is difficult to confirm whether or not paper sheets exist in the paper discharge space. Consequently, an operator thrusts his or her hands into the paper discharge space and searches the paper discharge space, to confirm the presence or absence of the paper sheets. However, such an operation is very troublesome to the operator.

In the multi-function image forming apparatus, an optical system is generally arranged above the paper discharge space. The multi-function image forming apparatus may, in some cases, be so assembled that an upper portion including the optical system is put on a lower portion below the upper portion. In this case, when the operator puts the upper portion on the lower portion while supporting the upper portion with lower parts on both its sides in both his or her hands, the upper portion must be put while satisfactorily pulling out the hands so that the hands are not caught between both the portions. Therefore, it is difficult to put the upper portion on a high-precision position.

On the other hand, in the image forming apparatus, paper sheets are passed between a heat roller and a pressure roller which serve as a fixing roller, to heat and fix a toner image formed on the paper sheets.

If the temperature of the fixing roller is too high, so-called high-temperature offset occurs. If the temperature thereof is too low, insufficient fixing occurs. Therefore, the temperature of the fixing roller must be kept constant. Conventionally, cooling air is caused to flow along the axial direction of the fixing roller from its one end to the other end in the axial direction of the fixing roller.

In a conventional cooling system, however, a portion on the downstream side in the direction of air blowing of the fixing roller is cooled by air whose temperature is increased upon being heated on the upstream side in the direction of air blowing, whereby cooling efficiency is degraded. As a result, the temperature in the portion on the downstream side in the direction of air blowing is significantly increased as the temperature distribution of the fixing roller.

SUMMARY OF THE INVENTION

An object of the present invention is to provide an image forming apparatus capable of easily visually confirming the presence or absence of a paper sheet discharged into a paper discharging section.

In order to attain the above-mentioned object, in a preferred mode of the present invention, an image forming apparatus comprises a paper discharging section which is so formed as to open toward the front in its main body and into which a paper sheet having an image recorded thereon is discharged, and a window formed on a side surface of the main body for lighting the paper discharging section.

In this mode, light enters the paper discharging section through the window for lighting, whereby it can be easily visually confirmed whether or not a paper sheet exists in the paper discharging section. If the window incorporates light, it may be opened or closed by a transparent plate or the like.

In a still preferred mode of the present invention, the image forming apparatus further comprises an optical system for illuminating an original put on an original platen surface to obtain an image corresponding to its original surface, an image forming section for recording the image obtained by the optical system on the paper sheet, and a paper conveying section for discharging the paper sheet into the paper discharging section through a paper conveying path passing through the image forming section. The main body of the image forming apparatus includes a first portion containing the optical system and a second portion containing the image forming section and the paper conveying section upon being combined below the first portion. The window is composed of an opening formed in an abutting portion of respective side surfaces of the first and second portions. The size and the position of the window are so set that an operator's hand supporting an approximately central part of each of side surfaces of the first portion can be introduced into the opening at the time of assembling.

In this mode, the first portion is put on the second portion in a state where an operator supports approximately central parts on both side surfaces of the first portion in his or her hands in assembling the main body of the image forming apparatus. At this time, both the hands respectively enter the openings, whereby the image forming apparatus can be assembled with high positional precision without catching the hands therebetween. The approximately central parts on the side surfaces of the first portion are portions in which a line connecting both the hands supporting the portions passes through the vicinity of the center of gravity of the first portion, that is, the first portion can be supported in a well-balanced manner.

In a still more preferred mode of the present invention, the image forming apparatus further comprises a fixing roller arranged along the longitudinal direction of the main body of the image forming apparatus and in close proximity to the window, and air blowing means for sending air along the axial direction of the fixing roller. The window comprises an opening for introducing cooling air by the air blowing means, which mainly corresponds to a portion on the downstream side in the direction of air blowing of the fixing roller.

In this mode, the following function is performed. Specifically, in the prior art in which constant air flows through the whole in the axial direction of the fixing roller, the temperature in the portion on the downstream side in the direction of air blowing of the fixing roller is liable to be increased. On the other hand, in the present invention, air sucked from the opening mainly cools the portion on the downstream side in the direction of air blowing of the fixing roller. As a result, the temperature of the fixing roller can be made uniform in the axial direction. Further, the opening is used for both lighting and taking in cooling air, whereby the construction can be simplified, as compared with that in a case where portions for lighting and taking in cooling air are separately formed.

The fact that the opening mainly corresponds to the portion on the downstream side in the direction of air blowing of the fixing roller means that it may or may not include a central part in the axial direction of the fixing roller as a portion corresponding to the opening. The reason for this is that such an arrangement of the opening that the cooling air introduced from the opening can make the temperature distribution of the fixing roller uniform in the axial direction is sufficient.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENT

Figure 1:
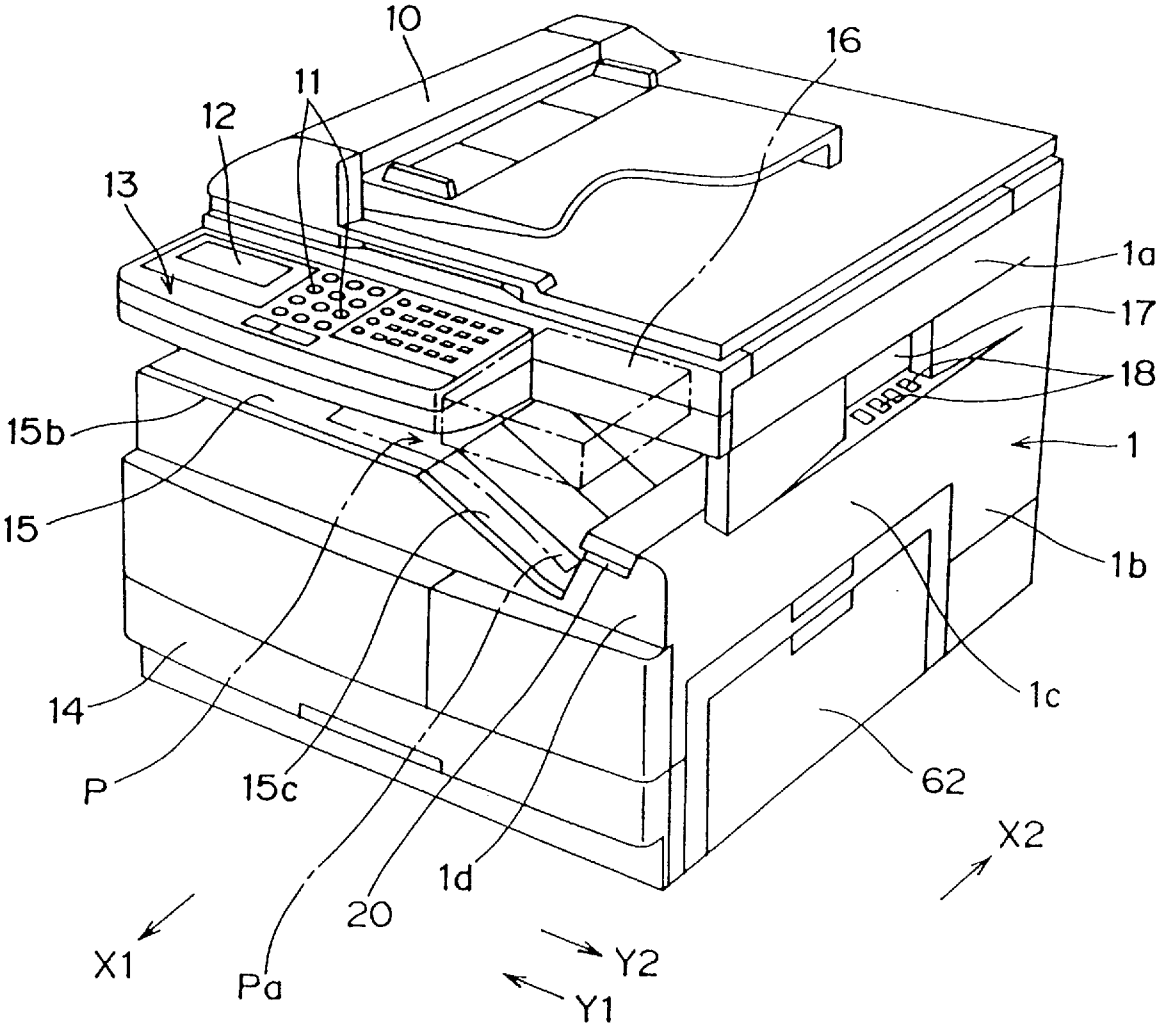
FIG. 1 is a schematic perspective view showing an image forming apparatus according to one embodiment of the present invention.

An embodiment of the present invention will be described while referring to the drawings.

FIG. 1 is a schematic perspective view showing an image forming apparatus according to one embodiment of the present invention. Referring to FIG. 1, an automatic document feeder 10 (hereinafter merely referred to as an ADF 10) is provided on the upper surface of the main body of an image forming apparatus 1, and an operation panel 13 having various operation keys 11 and a display section 12 is arranged in front of the upper part of the main body of the image forming apparatus 1. The operation panel 13 is thus arranged in front of the upper part of the main body of the image forming apparatus 1, whereby the upper surface of the main body of the image forming apparatus 1 is so effectively utilized that the ADF 10 is arranged thereon. Further, the main body of the image forming apparatus 1 has a paper discharging section 15 opening toward the front X1 below the operation panel 13. A paper feeding cassette 14 which can be pulled out forward X1 from the main body of the image forming apparatus 1 is mounted on the lower part of the main body of the image forming apparatus 1.

On the other hand, the image forming apparatus is equipped with a modem for modulating image data to be transmitted and demodulating image data to be received and an NCU (Network Control Unit) for making connection to an external communication network, which are not illustrated, in order to perform a facsimile function in addition to a copy function.

Figure 2:
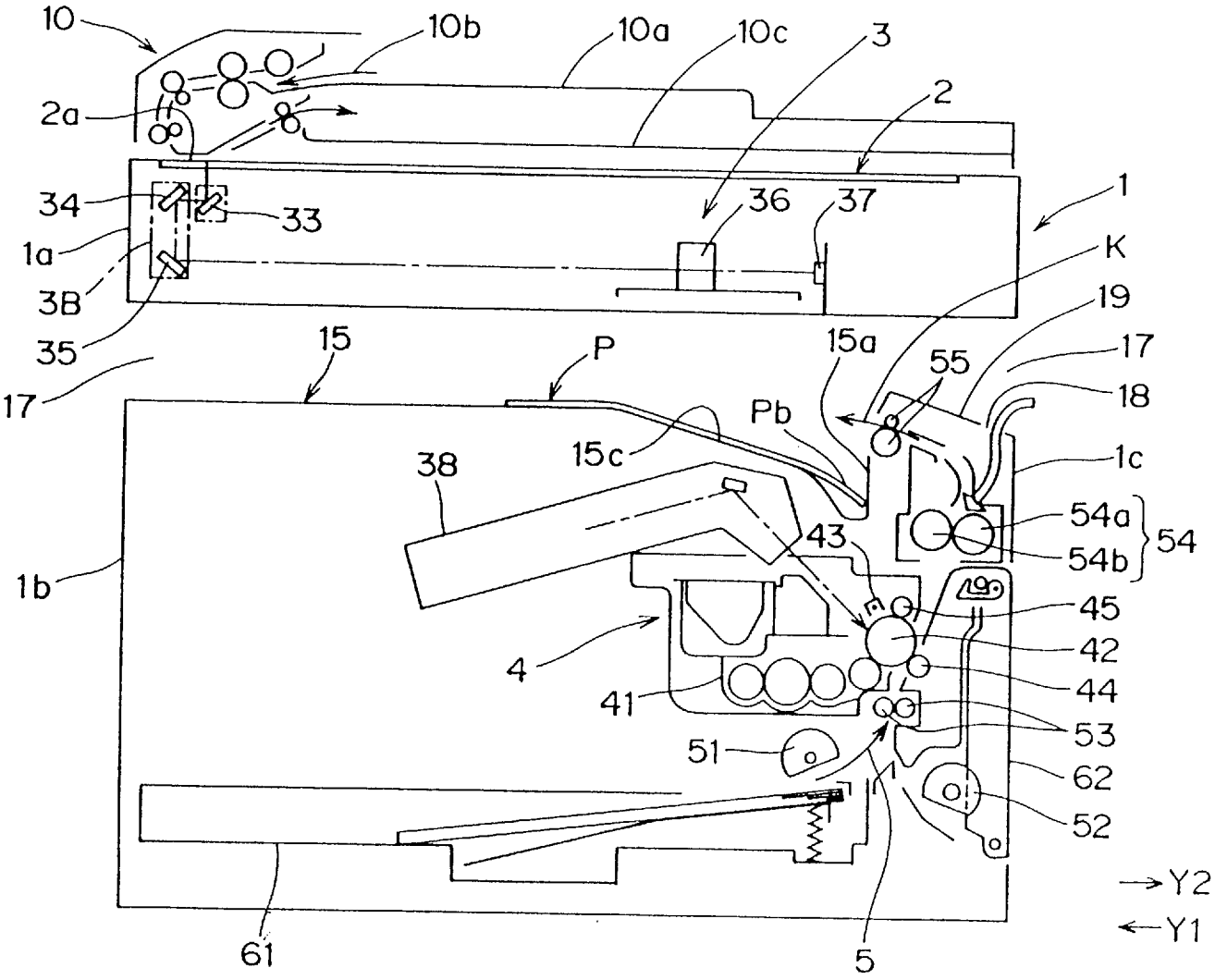
FIG. 2 is a schematic front view showing the internal construction of the image forming apparatus.

Referring to FIG. 2 which is a schematic front view showing the internal cross section of the image forming apparatus, in the image forming apparatus, when the ADF 10 is used, an original is conveyed to a reading region for ADF 2*a* by the ADF 10, while its original surface is illuminated and scanned by an optical system brought into a fixed state, and an image is formed on the basis of the illumination and scanning. On the other hand, when a book original, for example, is put on an original platen surface 2 to make copies, its original surface is illuminated and scanned by a moving optical system, and an image is formed on the basis of the illumination and scanning.

In the ADF 10, when a plurality of originals whose surfaces are directed upward are set in an original setting section 10*a*, the originals pass through the reading region 2*a* set in an end of the original platen surface 2 while being reversed through an original conveying path 10*b*, and are then successively discharged into an original discharge stand 10*c* in a state where they are turned over in descending order from the uppermost original.

The main body of the image forming apparatus 1 comprises in its inner part (1) an optical system 3 for illuminating and scanning an original put on the original platen surface 2 or an original conveyed to the reading region for ADF 2*a* by the ADF 10 and introducing light reflected from the original into the photosensitive drum 42, (2) an image forming section 4 for developing an electrostatic latent image formed on a photosensitive drum 42 by a developing device 41 and then transferring the electronic latent image on paper sheets, (3) a paper conveying section 5 for pulling out the paper sheets from a paper feeding cassette 61 or a manual paper feeding tray 62 opened at a required time and discharging the paper sheets into a paper discharging section 15 in the main body of the image forming apparatus 1 through the image forming section 4, and the like.

The optical system 3 illuminates the original by a fluorescent lamp with a reflecting plate (not shown) fixed to a first moving frame 3A, accepts the light reflected from the original in a line sensor 37 successively through a first mirror 33 fixed to the first moving frame 3A, a second mirror 34 fixed to a second moving frame 3B, a third mirror 35, and a lens 36, and irradiates laser light corresponding to input to the line sensor 37 onto the photosensitive drum 42 by a laser optical system 38. The laser optical system 38 is known one including a laser oscillator, a modulator, a lens, and a rotating polygon mirror, which are not illustrated in detail.

As the image forming section 4, a charging corona discharger 43, a developing device 41, a transfer roller 44, and a cleaning roller 45 are arranged in this order around the photosensitive drum 42. The image forming section 4 is so adapted as to form an original image on an outer peripheral surface of the photosensitive drum 42 uniformly charged by the charging corona discharger 43 to form an electrostatic latent image, then develop the electrostatic latent image into a toner image by the developing device 41, transfer the toner image on the paper sheets by the transfer roller 44, and recover the remaining toner by the cleaning roller 45. The image forming section 4 is formed as a unit as a whole, and can be integrally pulled out forward X.

The paper conveying section 5 comprises a paper feeding roller 51 for pulling out paper sheets P one at a time from the paper feeding cassette 61, a paper feeding roller 52 for pulling out the paper sheets from the manual paper feeding tray 62, a pair of registration rollers 53 for causing the paper sheets P conveyed by each of the paper feeding rollers 51 and 52 to temporarily wait with leading ends of the paper sheets P abutting thereon, a heat roller 54*b* and a pressure roller 54*a* which constitute a fixing roller 54 for fixing a toner image transferred on the paper sheets P, and a pair of discharge rollers 55 in this order. The discharge rollers 55 discharge the paper sheets P leftward Y1 along the direction of conveyance K in FIG. 1.

Figure 3:
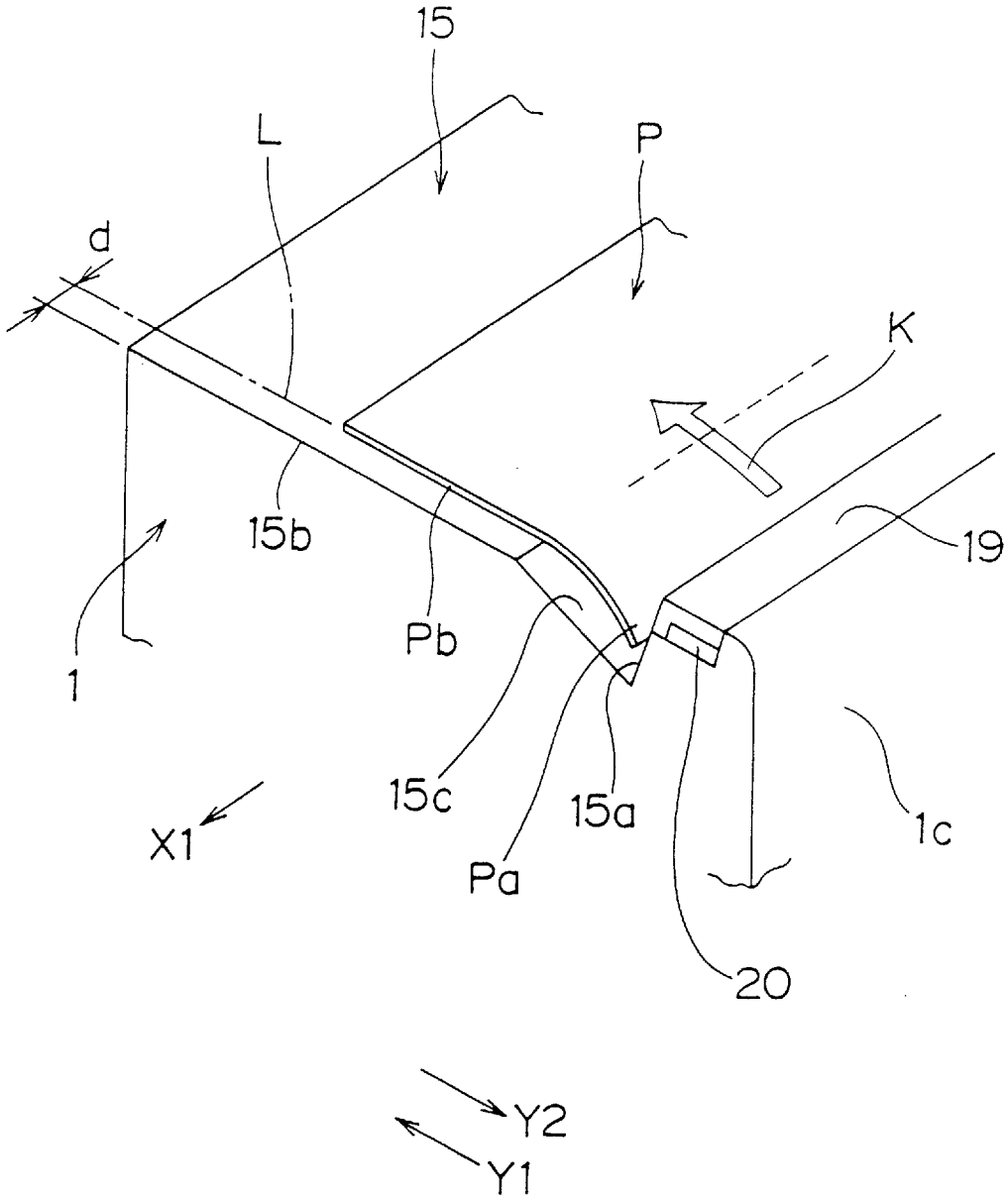
FIG. 3 is a schematic enlarged perspective view showing a paper discharging section.

Referring to FIG. 2 and FIG. 3 which is an enlarged schematic perspective view of the paper discharging section 15, the paper sheets are discharged into the paper discharging section 15 leftward Y1 along the direction of conveyance K. The paper discharging section 15 has an inclined section 15*c* so inclined that its portion corresponding to rear ends Pa in the direction of conveyance of the paper sheets P discharged is the lowest (inclined downward toward the right Y2 in the drawings). The rear ends Pa in the direction of conveyance of the paper sheets P discharged into the paper discharging section 15 are lined up at a rear end 15*a* in the direction of conveyance of the paper discharging section 15 by the function of the inclined section 15*c*. Even if a lot of paper sheets P are discharged into the paper discharging section 15 to enter a laminated state, the rear ends Pa in the direction of conveyance of the paper sheets P in the laminated state do not prevent a paper sheet P to be subsequently discharged from being discharged.

Figure 5:
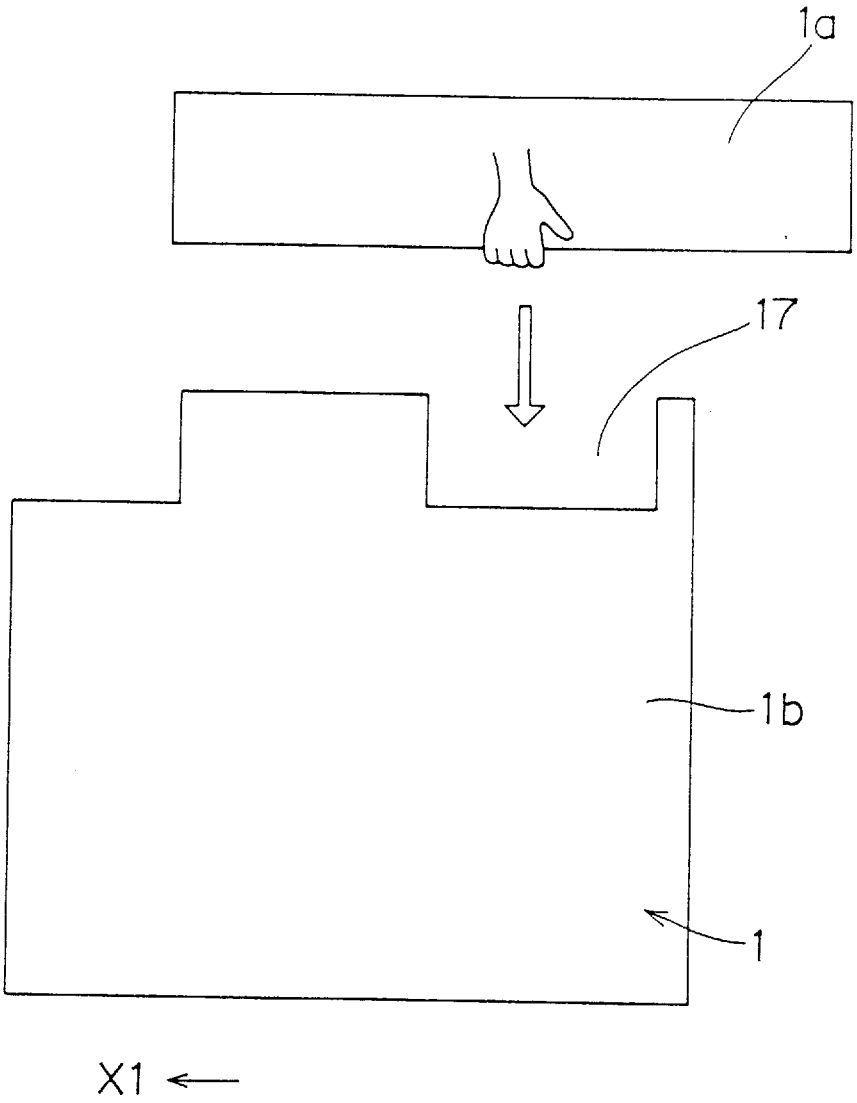
FIG. 5 is a schematic side view showing one step in a case where the main body of the image forming apparatus is assembled.

As mentioned above, the optical system 3, the image forming section 4, the paper conveying section 5, and the like are contained in the main body of the image forming apparatus 1. However, referring to FIG. 2, a first portion 1*a* containing the optical system 3 and a second portion 1*b* containing the image forming section 4 and the paper conveying section 5 below the first portion 1*a* are separably constructed. When the image forming apparatus is assembled, the first portion 1*a* and the second portion 1*b* are combined with each other with the first portion 1*a* put on the second portion 1*b*, as shown in FIG. 5. The paper discharging section 15 is provided on the upper part of the second portion 1*b* and is interposed between the first portion 1*a* and the second portion 1*b*.

On the other hand, referring to FIGS. 1 and 2, openings 17 (only one of them is illustrated in FIG. 1) serving as windows for lighting which connect the paper discharging section 15 with the exterior are respectively formed on both side surfaces of the main body of the image forming apparatus 1. Consequently, light is introduced into the paper discharging section 15 so that a space of the paper discharging section 15 is not darkened, to make it easy to visually confirm the paper sheets P discharged into the paper discharging section 15.

Each of the openings 17 is provided in an abutting portion of respective side surfaces of the first and second portions 1*a* and 1*b*. The size and the position of each of the openings 17 are so set that an operator's hand supporting a lower edge in an approximately central position of each of side surfaces of the first portion 1*a* can be introduced into the opening, as shown in FIG. 5, at the time of assembling the image forming apparatus. When the main body of the image forming apparatus 1 is assembled, therefore, the hands are prevented from being caught between the first portion 1*a* and the second portion 1*b*, and both the portions 1*a* and 1*b* are combined with each other with high positional precision. Since the opening 17 is arranged in the second portion 1*b* in the present embodiment, it may be arranged in the first portion 1*a* or arranged so as to extend over both the portions 1*a* and 1*b*.

Furthermore, a plurality of main vent holes 18 facing the opening 17 on a right side surface 1*c* of the main body of the image forming apparatus 1 are provided in a portion 19 for sectioning an upper surface on the right side of the second portion 1*b* so as to connect with the paper discharging section 15. On the other hand, a sub vent hole 20 having an open area significantly smaller than the open area of the whole of the plurality of main vent holes 18 is formed in the upper part of a front surface 1*d* of the second portion 1*b*. Cooling air is supplied to the fixing roller 54 through the vent holes 20 and 18.

Figure 4:
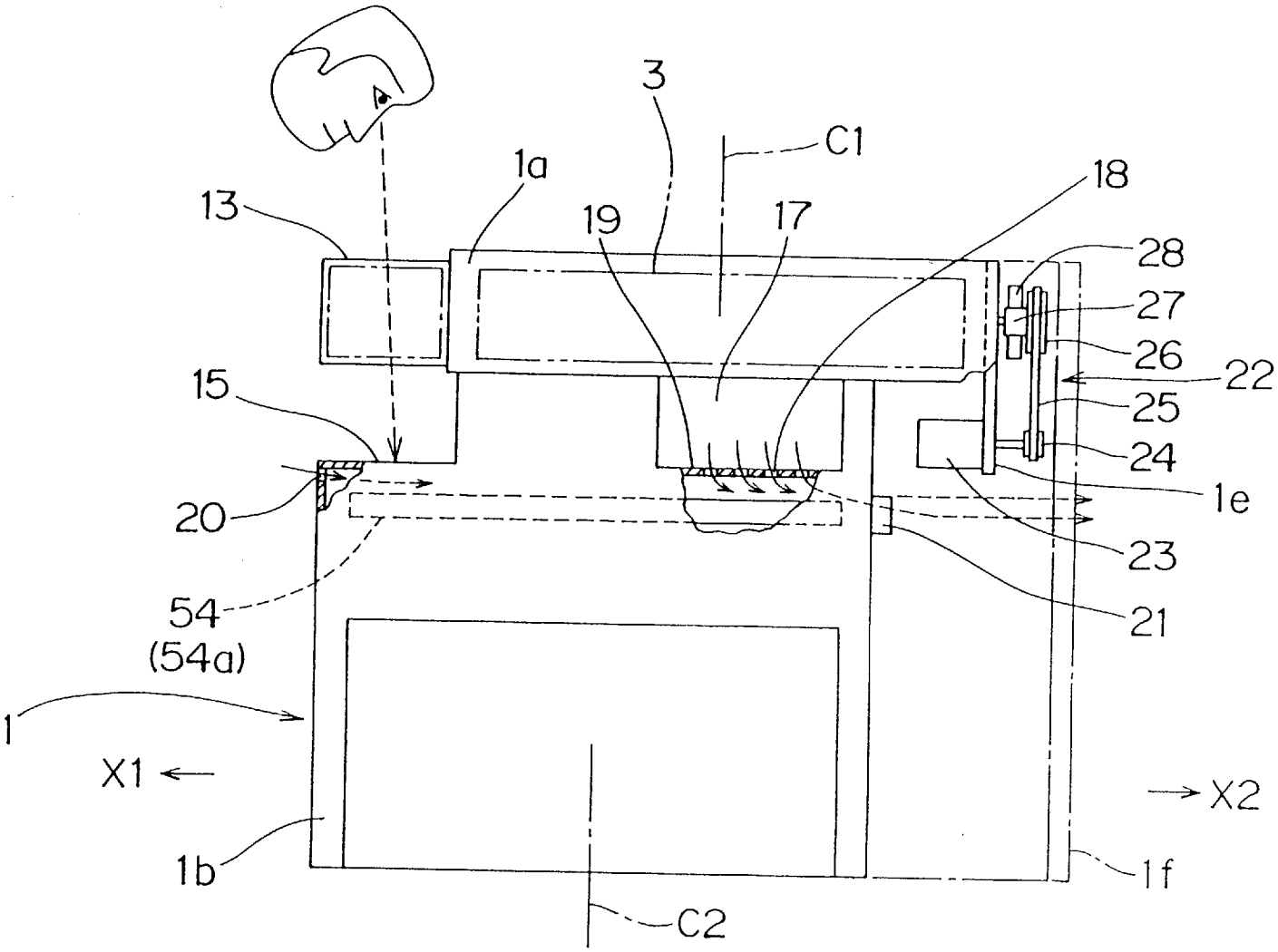
FIG. 4 is a partially broken schematic right side view of the main body of the image forming apparatus.

Referring to FIG. 4 which is a partially cutaway right side view of the main body of the image forming apparatus 1 (FIG. 4 shows a state where a surface cover on the right side surface of the main body of the image forming apparatus 1 is removed so that a plate-shaped frame is exposed), the fixing roller 54 is arranged along the forward direction X1 and the backward direction X2 in the image forming apparatus, and is in close proximity to the main vent holes 18. A fan for air blowing 21 is arranged in close proximity to a rear end in the axial direction of the fixing roller 54, and the fan 21 sucks air from the vent holes 20 and 18 to blow air backward X2 in the axial direction of the fixing roller 54. The periphery of the fixing roller 54 is so sectioned that air hardly flows into the fixing roller 54 from portions other than the vent holes 20 and 18. Further, the amount of air introduced from the sub vent hole 20 is so set as to be significantly smaller than the amount of air introduced from the whole of the main vent holes 20. On the other hand, the main vent holes 18 mainly correspond to a portion on the downstream side in the direction of air blowing of the fixing roller 54, to mainly cool the portion on the downstream side in the direction of air blowing. Consequently, the temperature distribution in the axial direction of the fixing roller 54 is made uniform. The height of a lower end of a rear frame 1*e* is so set that the rear frame 1*e* does not block the flow of air expelled by the fan 21.

As shown in FIG. 4, the first portion 1*a* is arranged in a state where it is shifted by a predetermined amount backward X2 from the position where it is lined up with the second portion 1*b* (in FIG. 4, C1 denotes a line indicating the center in the longitudinal direction of the optical system 3, and C2 denotes a line indicating the center in the longitudinal direction of the image forming section). Consequently, a vacant space is formed in front of the first portion 1*a*. However, the operation panel 13 is so arranged as to occupy a part of the vacant space (see FIG. 1), and a side space 16 is formed on the right Y2 of the operation panel 13 by the remaining space. An operator can visually confirm from above the presence or absence of paper sheets P discharged into the paper discharging section 15, as shown in FIG. 4, through the side space 16. Since the side space 16 is positioned above the rear ends Pa in the direction of conveyance of the discharged paper sheets P, as shown in FIG. 1, it can be easily visually confirmed whether the paper sheets P are in the paper discharging section 15 irrespective of the paper size.

Figure 6:
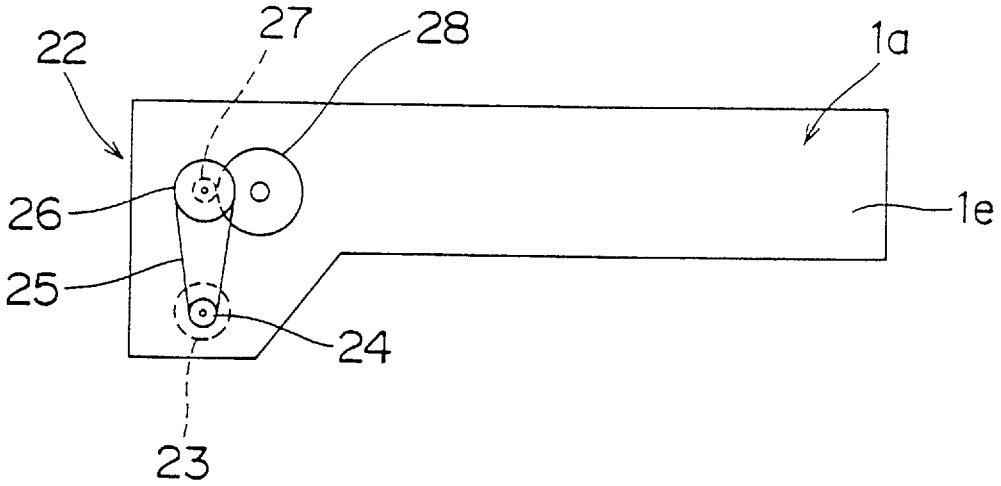
FIG. 6 is a schematic view showing a rear frame of a first portion.

Referring to FIG. 4 and FIG. 6 showing a rear frame of the first portion 1*a,* a driving member 22 for driving the optical system 3 contained in the first portion 1*a* is supported on the rear frame 1*e* in the first portion 1*a*. The driving member 22 comprises a motor 23, a driving pulley 24 fixed to the axis of rotation of the motor 23, a driven pulley 26 driven by the driving pulley 24 through a belt 25, a first gear 27 rotated integrally with the driven pulley 26, and a second gear 28 engaged with the first gear 27. The motor 23 and the driven pulley 24 out of the members 23 to 27 included in the driving member 22 are arranged behind the second portion 1*b*.

Particularly, the motor 23 is arranged in a vacant space formed below the first portion 1*a* and behind the second portion 1*b* by shifting the first portion 1*a* backward. The vacant space means the place where the second portion 1*b* does not exist below the first portion 1*a*. If the first portion 1*a* is merely shifted backward with the motor 23 arranged on the rear surface of the first portion 1*a,* a plane space occupied by the whole of the image forming apparatus is widened. In the present embodiment, however, the motor 23 is arranged behind the second portion 1*b,* a plane space occupied by the image forming apparatus is not increased.

Since the motor 23 is mounted on an inner side surface of the rear frame 1*e,* referring to FIG. 4, it is arranged at a distance away from a rear cover 1*f* of the main body of the image forming apparatus 1 (that is, an inner part of the main body of the image forming apparatus 1), and is arranged in a state where it is shielded by the rear frame 1*e,* as compared with a conventional case where it is mounted on an outer side surface of the rear frame 1*e*. As a result, a motor sound at the time of operating the apparatus cannot easily escape outward from the apparatus, whereby the decrease in noise is expected.

As shown in FIG. 3, a paper conveying path is so set that the paper sheets P are discharged in a state where front edges Pb on the take-out side of the paper sheets P discharged into the paper discharging section 15 are along a line L at a predetermined small distance d (for example, 20 mm) apart from the front edge 15*b* of the paper discharging section 15. That is, the paper conveying path forms a so-called front basis of the apparatus. Since the paper conveying path thus forms such a front basis, the front edges Pb of the paper sheets P discharged into the paper discharging section 15 are at a predetermined small distance (for example, 20 mm) apart from the front edge 15*b* of the paper discharging section 15. As a result, the paper sheets P are easily taken out forward from the paper discharging section 15 irrespective of the paper size.

According to the present embodiment, light enters the paper discharging section 15 through the opening for lighting 17, whereby it is easy to visually confirm whether or not the paper sheets P exist in the paper discharging section 15.

When the operator puts the first portion 1*a* on the second portion 1*b* in a state where the approximately central parts on both the side surfaces of the first portion 1*a* are supported with both his or her hands at the time of assembling the image forming apparatus, both the hands respectively enter the openings 17, whereby the image forming apparatus can be assembled with high positional precision without catching the hands therebetween.

Furthermore, air sucked from the exterior through the openings 17 and the main vent holes 18 mainly cools a portion on the downstream side in the direction of air blowing of the fixing roller 54 where cooling efficiency is liable to be reduced. As a result, the temperature distribution of the fixing roller 54 can be made uniform in the axial direction. Consequently, it is possible to solve insufficient fixing caused by non-uniformity of temperature.

Figure 7:
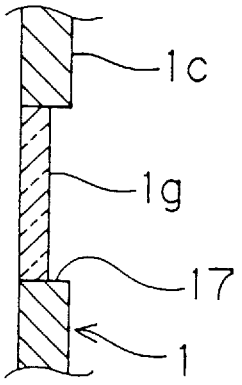
FIG. 7 is a cross section of right side view of the main portion of the main body of the image forming apparatus according to another embodiment of the present invention.

In the embodiment of the present invention, the opening for lighting 17 is also used for taking in cooling air. When the opening 17 is utilized only for lighting, the opening 17 may be used as a window upon being closed by a transparent plate 1*g* (referring to FIG. 7).

Furthermore, cooling air may cool only the heat roller 54*b* or cool only the pressure roller 54*a*. Alternatively, both the rollers 54*a* and 54*b* may be cooled.

In addition thereto, various changes can be made in the scope of the present invention.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a paper discharging section which is so formed as to open toward a front in a main body of the image forming apparatus and into which a paper sheet having an image recorded thereon is discharged, the paper discharge section including a stacking portion at which discharged sheets are stacked, and the paper discharge section defining a paper take out opening through which discharged sheets are taken out; and a window formed on a surface of the main body of the image forming apparatus for lighting the paper discharging section, the window having an opening located remotely from the paper take out opening, the window opening admitting light for lighting the stacking portion.

2. An image forming apparatus according to claim 1, further comprising an optical system for illuminating an original put on an original platen surface to obtain an image corresponding to an original surface, an image forming section for recording the image obtained by the optical system on the paper sheet, and a paper conveying section for discharging the paper sheet into the paper discharging section through a paper conveying path passing through the image forming section, the main body of the image forming apparatus including a first portion containing the optical system and a second portion containing the image forming section and the paper conveying section upon being combined below the first portion.

3. An image forming apparatus according to claim 2, wherein the window opening is located in an abutting portion of respective side surfaces of the first and second portions.

4. An image forming apparatus according to claim 3, wherein the window opening has a predetermined size and a predetermined position corresponding to an approximately central part of each of side surfaces of the first portion.

5. An image forming apparatus comprising:

a paper discharging section which is so formed as to open toward a front in a main body of the image forming apparatus and into which a paper sheet having an image recorded thereon is discharged;

a window formed on a surface of the main body of the image forming apparatus for lighting the paper discharging section;

a fixing roller arranged along a longitudinal direction of the main body of the image forming apparatus and in close proximity to the window; and air blowing means for blowing air in a blowing direction along an axial direction of the fixing roller, and wherein the window comprises an opening for introducing cooling air by the air blowing means.

6. An image forming apparatus according to claim 5, wherein the opening of the window mainly corresponds to a portion on a downstream side in the blowing direction of the fixing roller.

7. An image forming apparatus according to claim 1, wherein the window opening is covered with a transparent plate.

* * * * *